US006851520B2

(12) United States Patent
Nagata et al.

(10) Patent No.: US 6,851,520 B2
(45) Date of Patent: Feb. 8, 2005

(54) HOISTING MACHINE HAVING BRAKING DEVICE WITH FULCRUMS, ETC., ARRANGED BELOW BRAKE WHEEL, AND ELEVATOR SYSTEM USING SAME

(75) Inventors: Koji Nagata, Aichi (JP); Yukimasa Hisamitsu, Nagoya (JP)

(73) Assignee: Kabushiki Kaisha Meidensha, Tokyo (JP)

( * ) Notice: Subject to any disclaimer, the term of this patent is extended or adjusted under 35 U.S.C. 154(b) by 93 days.

(21) Appl. No.: 10/246,733

(22) Filed: Sep. 19, 2002

(65) Prior Publication Data

US 2003/0070881 A1 Apr. 17, 2003

(30) Foreign Application Priority Data

Sep. 28, 2001 (JP) ..... 2001-302049

(51) Int. Cl.[7] ..... B66B 5/06
(52) U.S. Cl. ..... 187/286; 187/254; 187/373
(58) Field of Search ..... 187/250, 254, 187/258, 259, 266, 268, 276, 277, 286, 287, 289, 351, 358, 362, 363, 373, 374, 378, 379

(56) References Cited

U.S. PATENT DOCUMENTS 4,960,186 A * 10/1990 Honda ..... 187/254
5,018,603 A * 5/1991 Ito ..... 187/254
5,144,183 A * 9/1992 Farrenkopf ..... 310/268
5,665,944 A * 9/1997 Aulanko et al. ..... 187/277
5,873,434 A * 2/1999 Sugita et al. ..... 187/288
5,982,060 A * 11/1999 Hakala et al. ..... 310/67 R
5,996,742 A 12/1999 Aulanko et al.
6,021,872 A 2/2000 Sevilleja et al.
6,397,974 B1 * 6/2002 Adifon et al. ..... 187/254

FOREIGN PATENT DOCUMENTS

| | | |
|---|---|---|
| EP | 0 970 912 A2 | 1/2000 |
| EP | 1 118 575 A2 | 7/2001 |
| JP | 2000-16727 | 1/2000 |

* cited by examiner

*Primary Examiner*—Jonathan Salata
(74) *Attorney, Agent, or Firm*—Foley & Lardner LLP

(57) ABSTRACT

A hoisting machine includes a stationary part having a shank and a stationary frame integrally formed with the shank, and a motor stator provided to the stationary frame. A rotary part includes a rotary frame rotatably supported to the shank through a bearing and facing the stationary frame, a sheave integrally formed with the rotary frame on the side opposite to the stationary frame, a motor rotator arranged at the outer periphery of the rotary frame and facing the motor stator, and a brake wheel integrally formed with the rotary frame and having a larger diameter than that of the sheave. A braking device is mounted to the stationary frame and coming in contact with the brake wheel for braking operation.

10 Claims, 6 Drawing Sheets

HOISTING MACHINE HAVING BRAKING DEVICE WITH FULCRUMS, ETC., ARRANGED BELOW BRAKE WHEEL, AND ELEVATOR SYSTEM USING SAME

BACKGROUND OF THE INVENTION

The present invention relates to a hoisting machine which is suitable for application, particularly, to elevator systems.

An elevator system provided with a hoisting machine is disclosed in P2000-16727A. This elevator system comprises in a hoistway a pair of car guide rails vertically arranged at a given interval and a car vertically movably guided by the guide rails. The car includes a door for getting-on and getting-off and a pair of guide pulleys supported on the bottom of the car. A rope wound on the guide pulleys has a portion which runs below the car. One end of the rope is supported by a ceiling-side beam in the hoistway.

With the above elevator system, however, the hoisting machine is arranged in the hoistway having a wall on one side, leading to difficult maintenance. Moreover, as being arranged parallel to a counterbalance in the hoistway, the hoisting machine is required to be small in depth and width and excellent in mountability. Further, the hoisting machine is required to present simpler structure and higher reliability.

SUMMARY OF THE INVENTION

It is, therefore, an object of the present invention to provide a hoisting machine which is excellent in maintainability and mountability, and presents simpler structure and higher reliability at low manufacturing cost. Another object of the present invention is to provide an elevator system using such hoisting machine.

The present invention pertains to a hoisting machine which, in one embodiment, has a stationary part that takes the form of a shank, and a stationary frame which is integrally form with the shank. The hoisting machine further has a stater of a motor provided on the stationary frame. A rotary part, in the form of a rotary frame, is rotatably supported on the shank through a bearing and is arranged to face the stationary frame. A sheave, which is integrally formed with the rotary frame, is located on a side of the rotary frame that is opposite to the stationary frame. A rotator of the motor, is arranged at an outer periphery of the rotary frame so as to face the motor stator. A brake wheel is integrally formed with the rotary frame and has a diameter which is larger than that of the sheave. A braking device is mounted on the stationary frame so as to come into contact with the brake wheel when braking is required.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1B:
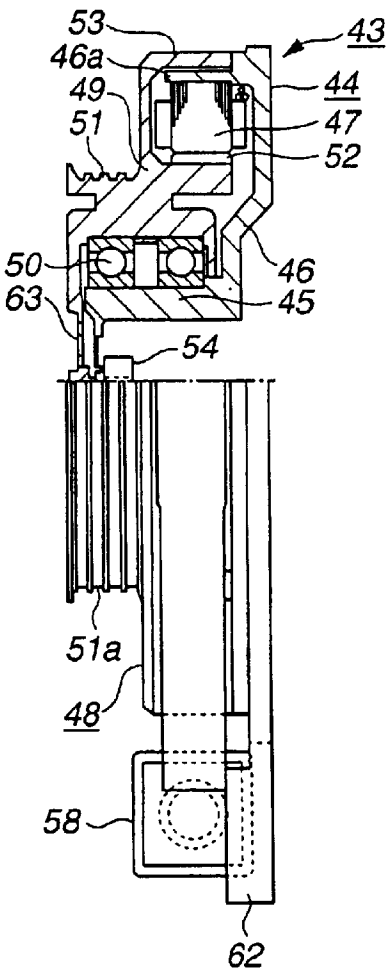
FIG. 1B is a side view, half in section, showing the hoisting machine.
Figure 1A:
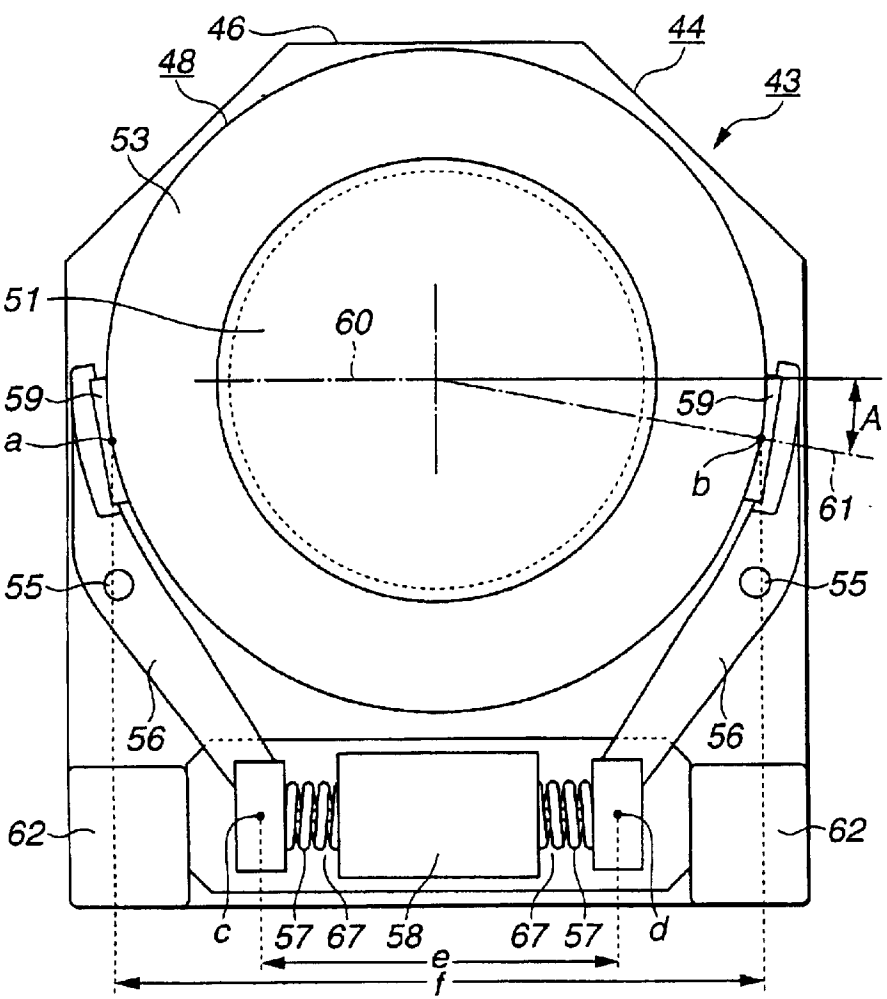
FIG. 1A is a front view showing an embodiment of a hoisting machine of an elevator system according to the present invention.
Figure 2B:
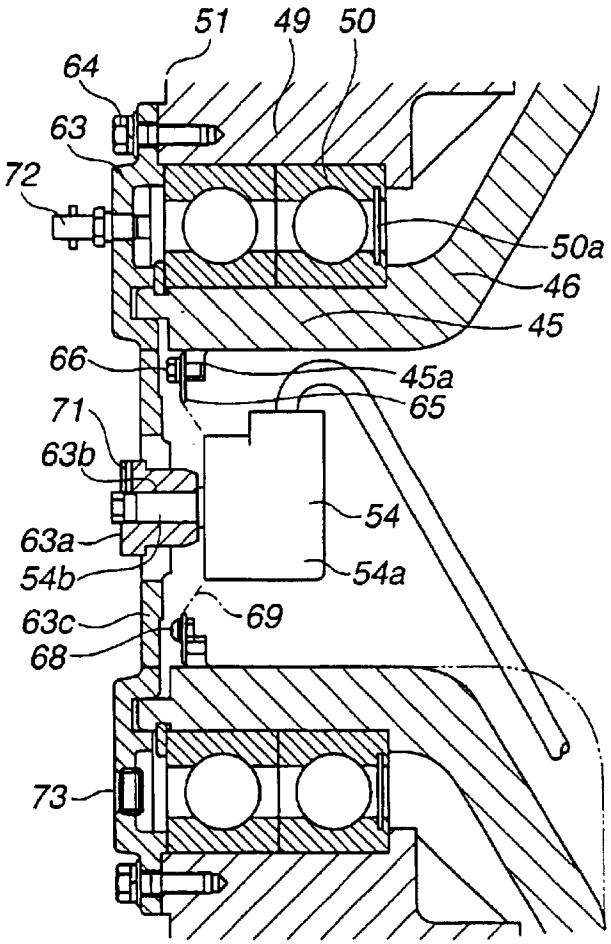
FIG. 2B is a fragmentary longitudinal section showing the hoisting machine.
Figure 2A:
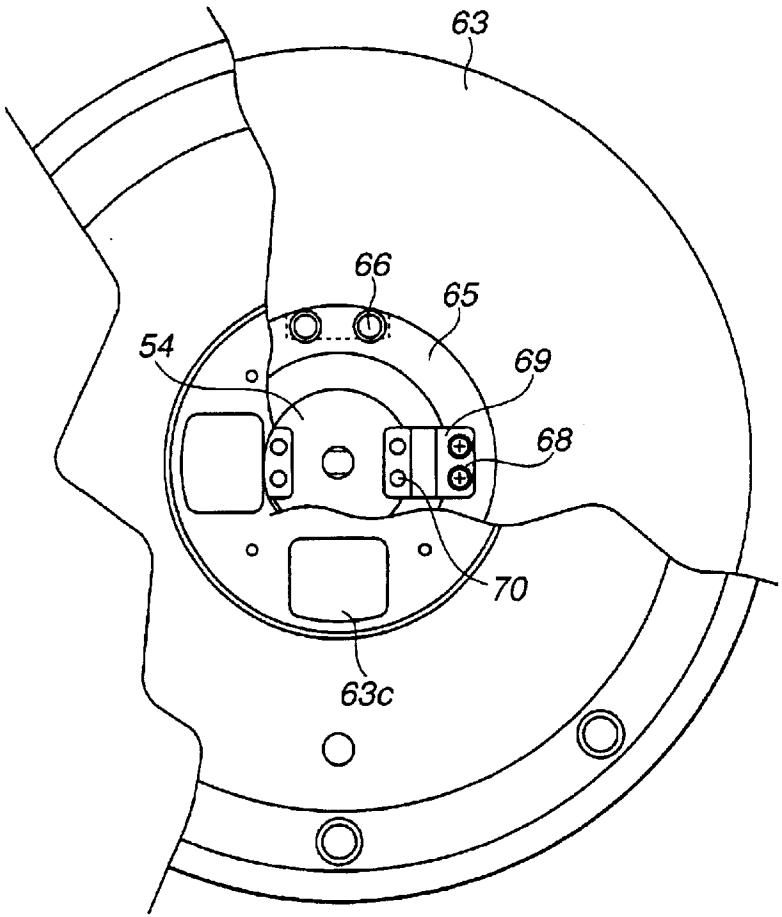
FIG. 2A is a fragmentary front view showing the hoisting machine.
Figure 3:
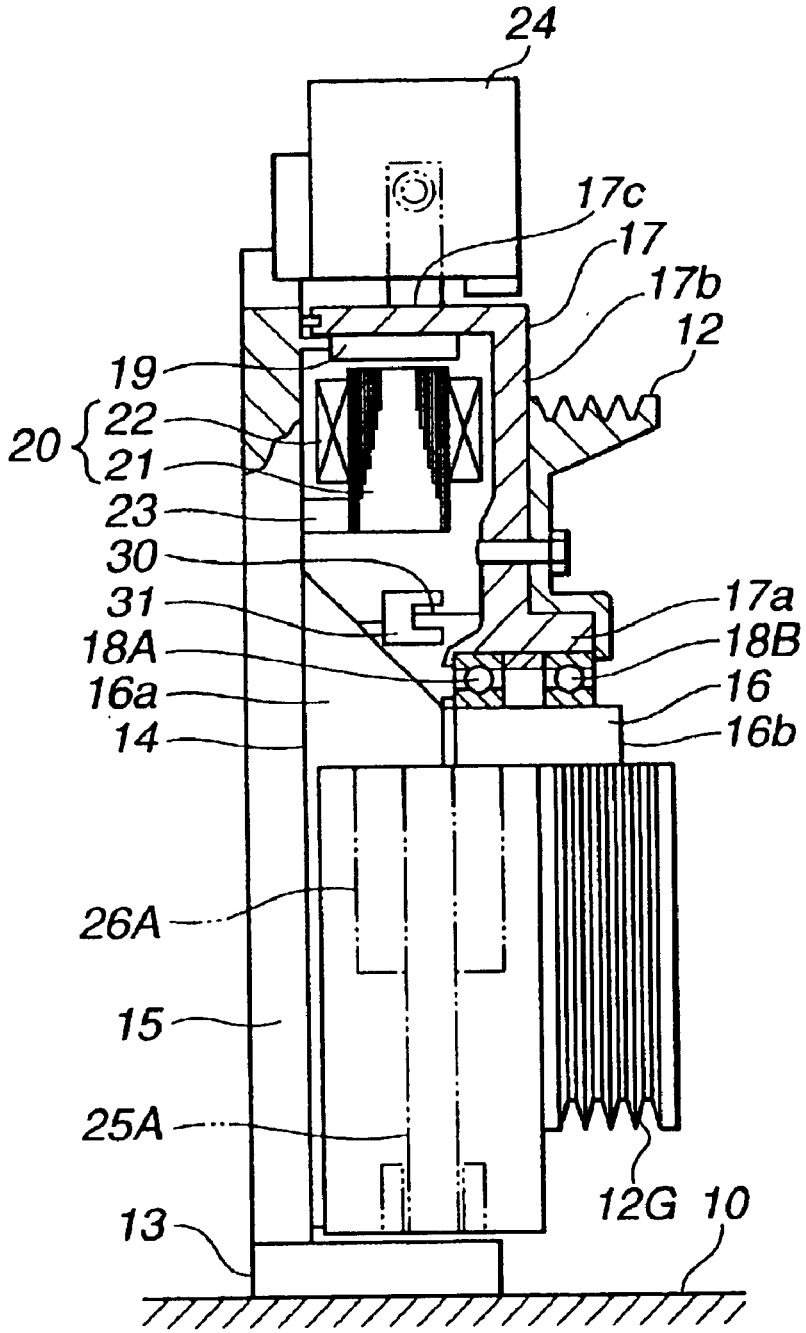
FIG.3 (RELATED ART)
FIG. 3 is a view similar to FIG. 1B, showing a related-art hoisting machine of an elevator system.
Figure 4:
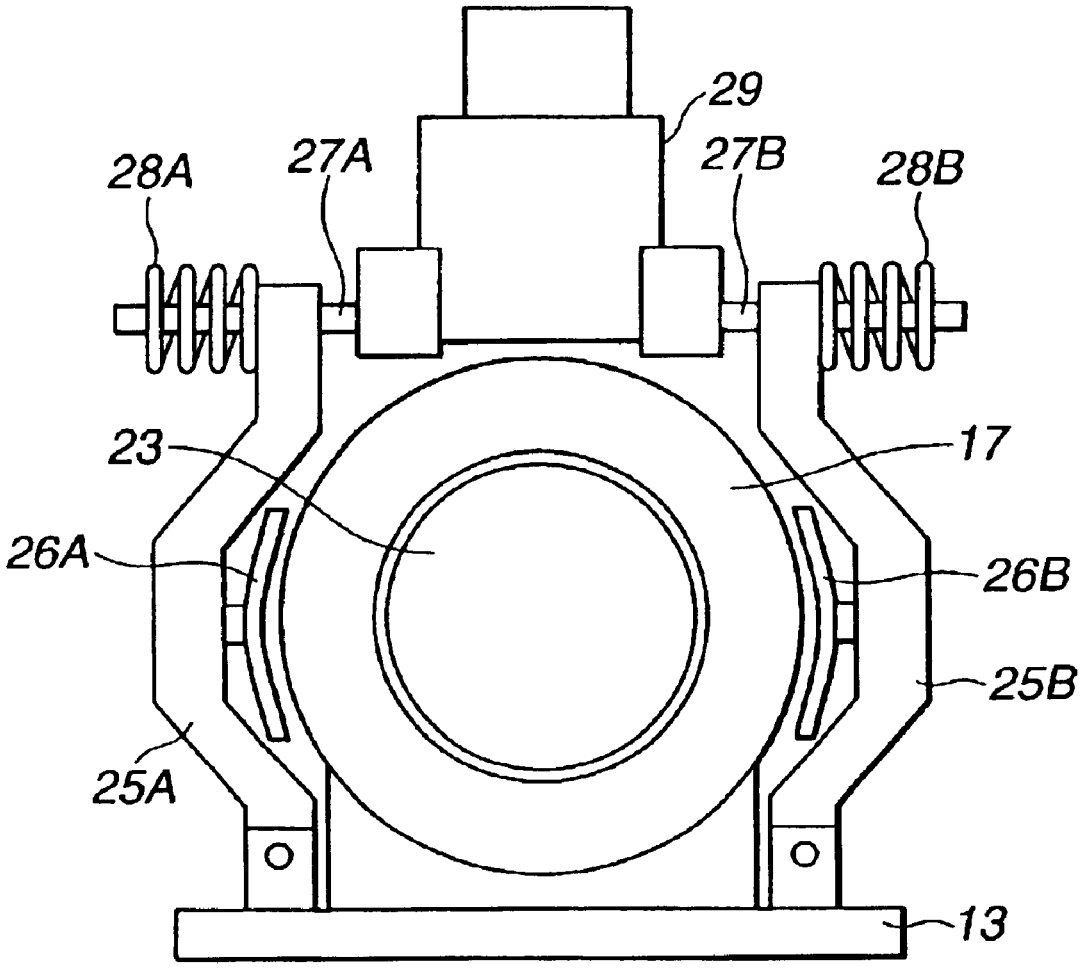
FIG.4 (RELATED ART)
FIG. 4 is a view similar to FIG. 1A, showing the related-art hoisting machine.
Figure 5:
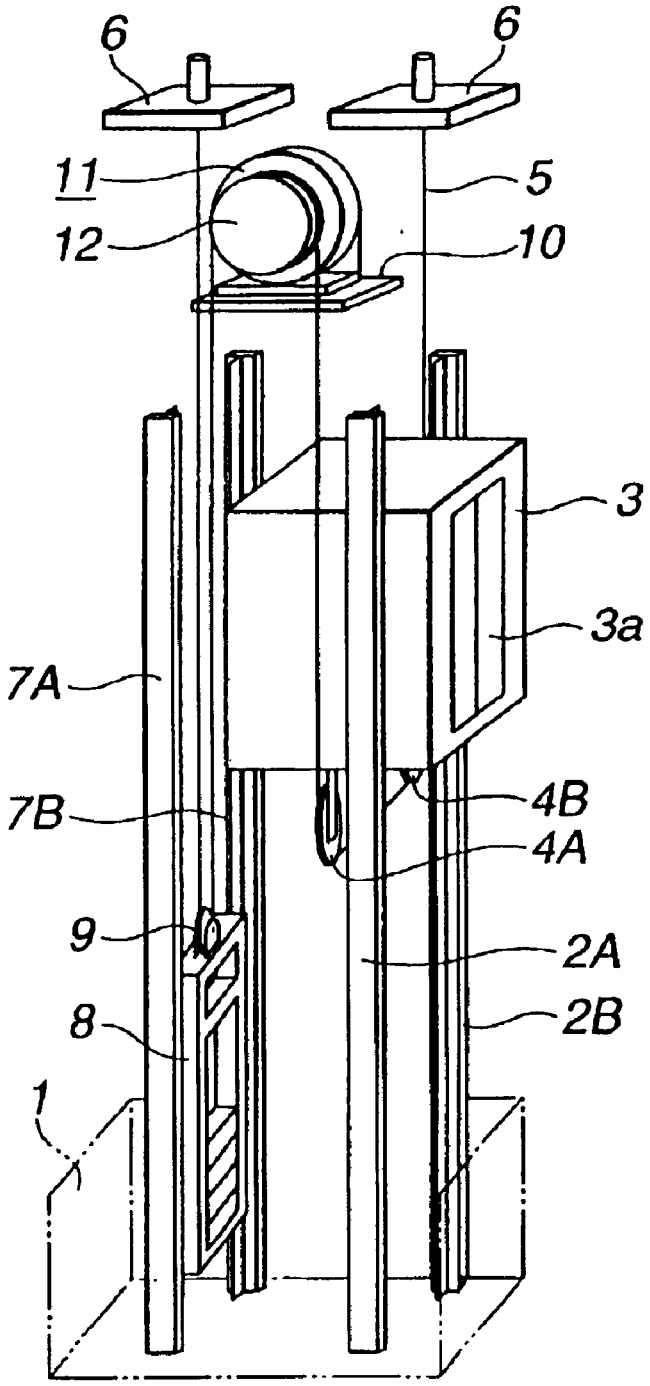
FIG.5 (RELATED ART)
FIG. 5 is a perspective view showing a related-art elevator system.

Before entering a description about the preferred embodiment of a hoisting machine according to the present invention, the elevator system disclosed in P2000-16727A is described in more detail. Referring to FIGS. 3–5, the elevator system comprises in a hoistway 1 a pair of car guide rails 2A, 2B vertically arranged at a given interval and a car 3 vertically movably guided by the guide rails 2A, 2B. The car 3 includes a door 3*a* for getting-on and getting-off and a pair of guide pulleys 4A, 4B supported on the bottom of the car 3. A rope 5 wound on the guide pulleys 4A, 4B has a portion which runs below the car 3. One end of the rope 5 is supported by a ceiling-side beam 6 in the hoistway 1.

In the hoistway 1, a pair of counterbalance guide rails 7A, 7B is vertically arranged parallel to the car guide rails 2A, 2B and at a given interval to guide a counterbalance 8 vertically movably. A guide pulley 9 is supported on the counterbalance 8. Another end of the rope 5 is wound on the guide pulley 9 and supported by the ceiling-side beam 6. A support 10 is arranged at an upper part of the hoistway 1, and a hoisting machine 11 is supported thereon. The hoisting machine 11 comprises a sheave 12 on which the rope 5 is wound to extend to the guide pulley 9 of the counterbalance 8 through the guide pulleys 4A, 4B of the bottom of the car 3.

The hoisting machine 11 comprises essentially a base 13 fixed on the support 10. Specifically, arranged on the base 13 is a stationary frame 15 having a vertical face 14 on which a stationary shaft 16 is supported in an overhang way to extend perpendicularly and then horizontally. The stationary shaft 16 includes a large-diameter portion 16*a* on the fixed-end side and a small-diameter portion 16*b* on the free-end side. A rotary frame 17 is rotatably supported on the small-diameter portion 16*b* through bearings 18A, 18B. The rotary frame 17 is formed like a bottomed cylinder or cup by a disk-like bottom 17*b* having a bearing holder 17*a* and a peripheral wall 17*c* arranged at the circumference of the bottom 17*b*. In order that an opening of the bottomed cylinder may approach the vertical face 14 of the stationary frame 15, the rotary frame 17 is rotatably supported on the small-diameter portion 16*b* of the stationary shaft 16 through the bearings 18A, 18B.

A rotator 19 is supported at the inner periphery of the peripheral wall 17*c* of the rotary frame 17, and a stator 20 having a radial gap with respect to the rotator 19 is fixed to the stationary frame 15. The stator 20 is formed out of a stator core 21 and a stator winding 22 wound thereon, and is fixed to the stationary frame 15 through a bracket 23. The rotator 19, the stator 20, the stationary frame 15 for supporting the stator 20, the rotary frame 17 for supporting the rotator 19, and the stationary shaft 16 for supporting the rotary frame 17 constitute an external-rotation type motor. The sheave 12 is fixed to the outside of the bottom 17*b* of the rotary frame 17, and has a rope groove 12G. A braking device 24 is arranged at the outer periphery of the rotary frame 17, and comprises, as seen in FIG. 4, a pair of brake arms 25A, 25B having one end supported by the base 13, a pair of brake shoes 26A, 26B supported by the brake arms 25A, 25B at the inside of the middle portion to face the outer periphery of the rotary frame 17, a pair of brake shafts 27A, 27B arranged through another ends of the brake arms 25A, 25B to face each other, a pair of brake springs 28A, 28B arranged to bring the brake shafts 27A, 27B closer together, and an electromagnet 29 which operates to separate the brake shafts 27A, 27B against the brake springs 28A, 28B.

A tubular body 30 is arranged with the bottom 17*b* of the rotary frame 17 to be coaxial with the stationary shaft 16. A sensor 31 is supported to enclose a slit formed in the tubular body 30 from both sides thereof, detecting the velocity of the motor.

With the above structure, the rope is moved by driving of the hoisting machine 11 through the sheave 12 to move upward and downward the car in the hoistway. Braking of the hoisting machine 11 is carried out by pressing the brake shoes 26A, 26B on the outer periphery of the rotary frame 17 by a pressing force of the brake springs 28A, 28B.

Figure 6:
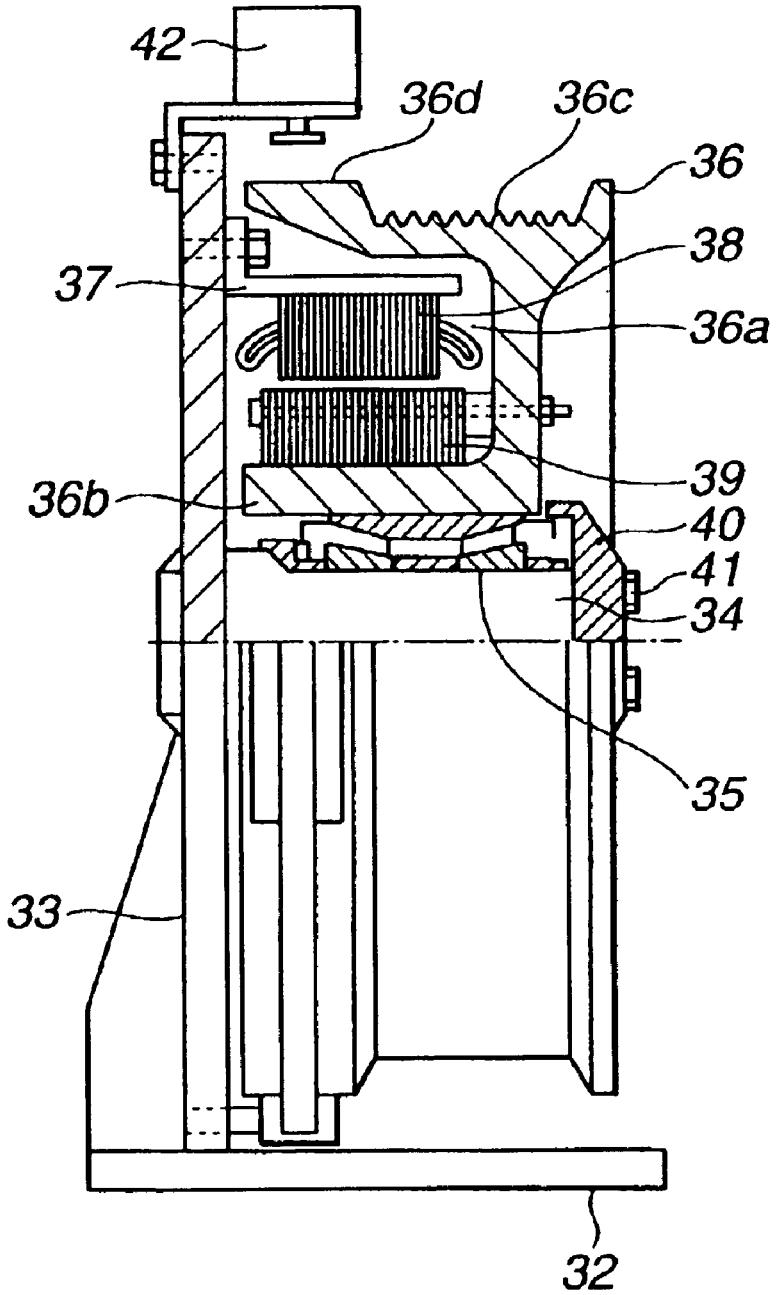
FIG.6 (RELATED ART)
FIG. 6 is a view similar to FIG. 3, showing another related-art hoisting machine of an elevator system.

Referring to FIG. 6, there is shown another example of the related-art hoisting machine of an elevator system. A vertical-type bracket 33 is arranged on a base 32, and a center shaft 34 is arranged to extend horizontally from the bracket 33. A sheave 36 is rotatably mounted to the center shaft 34 through a bearing 35, and is formed with a recess 36*a* which opens on the side of the bracket 33. A stator 38 is mounted to the bracket 33 through a stator bracket 37. The stator 38 comprises a winding and a core, and is disposed in the recess 36*a*. A rotator 39 is fixed at the outer periphery of a boss 36*b* which forms an inner wall of the recess 36*a* of the sheave 36 to face the stator 38. The stator 39 also comprises a winding and a core. The sheave 36 has a sheave groove 36*c* and a brake shoe 36*d* formed at the outer periphery. A bearing disengagement stop 40 is mounted at a front end of the center shaft 34 by a bolt 41. An electromagnetic brake part 42 is mounted to the vertical bracket 33 to engage with the brake shoe 36*d*.

With the structure in FIG. 6, when energizing the stator 38, torque is produced in the rotator 39, which is transferred to the sheave 38. Rotation of the sheave 38 causes the car to move upward and downward through the rope.

With the related-art elevator systems, the hoisting machine is arranged in the hoistway having a wall on one side, leading to difficult maintenance. Moreover, as being arranged parallel to the counterbalance in the hoistway, the hoisting machine is required to be small in depth and width and excellent in mountability. Further, the hoisting machine is required to present simpler structure and higher reliability.

Referring to FIGS. 1A–2B, there is shown an embodiment of the present invention. A hoisting machine 43 includes a stationary part 44 and a hollow shank 45. A stationary frame 46 is integrally formed with an end of the shank 45 in which a rotation sensor 54 for sensing the rotational speed of the motor. A protrusion 46*a* is formed at an outer end of the stationary frame 46 to protrude in the same direction as that of the shank 45. A motor stator 47 is arranged on the inner surface of the protrusion 46*a*. In such a way, the shank 45, the stationary frame 46, and the motor stator 47 constitute stationary part 44 of the hoisting machine 43.

The hoisting machine 43 includes a rotary part 48. A rotary frame 49 is disposed to face the stationary frame 46, and is rotatably supported to the shank 45 through a bearing 50. A sheave 51 is integrally formed with the rotary frame 49 on the side opposite to the stationary frame 46, and has a rope groove 51*a* formed at the outer periphery. A rope is wound on the rope groove 51*a*. The rope suspends a car which moves upward and downward in a hoistway, generally as shown in FIG. 5. A motor rotator 52 comprising a permanent magnet is arranged at the outer periphery of the rotary frame 49 to face the inner periphery of the motor stator 47. Moreover, a brake wheel 53 is integrally formed with the rotary frame 49 to protrude from the outer periphery thereof. Therefore, the brake wheel 53 is larger in diameter than the rotary frame 49 and the sheave 51. The rotary frame 49, the sheave 51, the motor rotator 52, and the brake wheel 53 constitute rotary part 48 of the hoisting machine 43.

A sensor bracket 63 is mounted to the rotary frame 49 in the position close to the center of the sheave 51 by a screw 64. A bracket portion 63*a* is press fitted in the center of the sensor bracket 63. A protrusion 45*a* is formed at the inner periphery of the shank 45, and an annular insulating plate 65 is mounted thereto by an insulating-plate fixing screw 66. The support member 69 has one end mounted to the insulating plate 65 by a rotation-sensor fixing screw 68, and another end mounted to a rotation-sensor main body 54*a* by a screw 70. On the other hand, a rotation-sensor shaft 54*b* is arranged through a hole 63*b* formed in the bracket portion 63*a* of the sensor bracket 63, and is fixed by a lock screw 71. Four adjusting holes 63*c* are arranged in the positions corresponding to the fixing screws 66, 68, etc. of the sensor bracket 63. A hole is formed in the sensor bracket 63 in the position corresponding to an outer end of the bearing 50, in which a grease nipple or the like is fitted to form a grease supply port 72. The bearing 50 includes a seal 50*a* arranged on the side opposite to the grease supply side so that grease supplied from the supply port 72 is charged in the bearing 50 without being discharged on the side opposite to the grease supply side. A grease discharge port 73 also includes a hole formed in the sensor bracket 63 in the position corresponding to the outer end of the bearing 50. The discharge port 73 is arranged preferably in the position 180 degrees offset with respect to the supply port 72.

A pair of brake arms 56 is rotatably supported to the stationary frame 46 through rotation shafts 55, and has one end to which one end of a pair of facing brake shafts 67 is coupled. A brake spring 57 for providing a braking force is arranged around the brake shaft 67. Another end of the brake shaft 67 is inserted in an electromagnet 58 which operates to release a braking force of the brake spring 57. The brake shaft 67, the brake spring 57, and the electromagnet 58 constitute a brake part. All of the brake arms 56, the brake shafts 67, the brake springs 57, and the electromagnet 58 are arranged below a horizontal center line 60 of the brake wheel 53. Brake pads 59 have a center line 61 positioned below the center line 60 by an angle A. Specifically, when the centers of the rotation shaft 55 are fulcrums, centers of contact "a", "b" of the brake pads 59 with the brake wheel 53 are points of action, and connections "c", "d" between the brake arms 56 and the brake shafts 67 are power points, the fulcrums, the points of action, and the power points are located below the center line 60 of the brake wheel 53.

When a distance between the power points "c", "d" is "e", and a distance between the points of action "a", "b" is "f", the distance "e" is smaller than the distance "f" (e<f). Terminal boxes 62 are arranged on the stationary frame 46 on the side of the sheave 51 and at the side of the power points "c", "d" to carry out electrical connection between the outside and the motor stator 47, electromagnet 58, and rotation sensor 54.

With the above structure, when energizing the motor stator 47, the sheave 51 integrated with the rotary frame 49 is rotated to move upward and downward the car in the hoistway through the rope. During rotation of the sheave 51, the electromagnet 58 is also energized to release braking by the brake springs 57. When braking the sheave 51, energization of the electromagnet 58 is stopped, and the brake pads 59 are pressed against the brake wheel 53 by a biasing force of the brake springs 57. At the time of maintenance of the rotation sensor 54, with the lock screw 71 for fixing the rotation-sensor shaft 54*b* being loosened, and the screw 64 being disengaged, the sensor bracket 63 is removed from the rotary frame 49 to draw the rotation-sensor shaft 54*b* from the bracket portion 63*a* of the sensor bracket 63. And the insulating-plate fixing screw 66 is disengaged to remove the rotation-sensor main body 54*a* from the shank 45. Thus, the maintenance of the rotation sensor 54 becomes prepared for implementation. By tightening or loosening of the adjusting holes 63*c* arranged to correspond to the fixing screws 66, 68, etc., fine adjustment of the rotation sensor 54 is carried out during alignment.

In this embodiment, the shank 45 for sustaining rotary motion, the stationary frame 46 integrated with the shank 45, and the motor stator 47 provided to the stationary frame 46 constitute stationary part 44 of the hoisting machine 43, whereas the rotary frame 49 rotatably supported to the shank 45, the sheave 51 integrated with the rotary frame 49, the brake wheel 53 integrated with the outer periphery of the rotary frame 49 and having larger diameter than that of the sheave 51, the motor rotator 52 arranged at the outer periphery of the rotary frame 49 constitute rotary part 48 of the hoisting machine 43. This allows simple and low-priced structure of the hoisting machine 43 with enhanced reliability, leading to suitable application to the elevator systems with a machine room eliminated.

Moreover, the stationary frame 46 is arranged in the hoistway on the wall side, so that the sheave 51 arranged on the side opposite to the stationary frame 46 is located on the inner side of the hoistway, leading to easy mounting/removal of the rope for suspending the car to/from the sheave 51. Further, the rotation sensor 54 is accommodated in the hollow shank 45 to detachably mount the rotation-sensor main body 54*a* thereto and screw the rotation-sensor shaft 54*b* to the sensor bracket 63 detachably mounted to the rotary frame 49, resulting not only in easy mounting/removal and maintenance of the rotation sensor 54 from the side of the sheave 51 by removing the sensor bracket 63, but also in easy maintenance of the other parts from the side of the sheave 51. Furthermore, the grease supply and discharge ports 72, 73 are formed in the sensor bracket 63 in the positions corresponding to the bearing 50 on the side of the sheave 51, allowing supply of grease to the bearing 50 from the side of the sheave 51, resulting in easy supply and change of grease. Further, braking of the sheave 51 is carried out by pressing the brake pads 59 to the brake wheel 53. Such drum brake is easier in maintenance than a built-in brake which requires disassembly of the motor. Still further, the terminal boxes 62 for electrical connection are arranged on the stationary frame 46 on the side of the sheave 51, allowing wiring connection on the side of the sheave 51, leading to easy implementation thereof.

Moreover, the motor part and the brake wheel 53 are arranged at the outer periphery of the rotary frame 49, and are larger in diameter than the sheave 51, allowing smaller thickness of the hoisting machine 43, leading to excellent mountability. Further, the brake wheel 53 is separated by the horizontal center line 60 to arrange the fulcrums, the points of action, and the power points of the braking device only in the lower outer peripheral portion of the brake wheel 53, allowing downsizing of the braking device and also the hoisting machine 43 using this device. Still further, the distance "e" between the power points "c", "d" is smaller than the distance "f" between the points of action "a", "b", resulting in secured rigidity of the brake arms 56 and reduced width of the hoisting machine 43. Furthermore, all maintenance work can be carried out from the side of the sheave 51, requiring no space between the stationary frame 46 and the wall of the hoistway, resulting in substantial downsizing of the hoisting machine 43.

Instead of being fixed in the hoistway, the hoisting machine 43 may be mounted to the car or the counterbalance.

Having described the present invention in connection with the preferred embodiment, it is noted that the present invention is not limited thereto, and various modifications and changes can be made without departing the scope of the present invention.

The entire teachings of Japanese Patent Application P2001-302049 filed Sep. 28, 2001 are incorporated hereby by reference.

What is claimed is:

1. A hoisting machine comprising:

a stationary part, the stationary part comprising a shank, a stationary frame integrally formed with the shank, and a stator of a motor provided to the stationary frame;

a rotary part, the rotary part comprising a rotary frame rotatably supported to the shank through a bearing and facing the stationary frame, a sheave integrally formed with the rotary frame on a side opposite to the stationary frame, a rotator of the motor arranged at an outer periphery of the rotary frame and facing the motor stator, and a brake wheel integrally formed with the rotary frame and having a larger diameter than that of the sheave; and a braking device mounted to the stationary frame, the braking device coming in contact with the brake wheel for braking operation, the braking device comprising:

a pair of rotation shafts;

a pair of brake arms, the brake arms being rotatably supported to the stationary frame through the rotation shafts;

a pair of brake pads each arranged at one end of the corresponding brake arm, the brake pads contacting and separating from the brake wheel; and a brake part connected to another end of the brake arms, the brake part providing and releasing a braking force of the brake pads, wherein when centers of the rotation hafts are fulcrums, centers of contact of the brake pads with the brake wheel are points of action, and connections between the brake arms and the brake part are power point, the fulcrums, the points of action, and the power points are located in a semicircular area of the brake wheel.

2. The hoisting machine as claimed in claim 1, wherein the shank of the stationary part is formed with a hollow space.

3. The hoisting machine as claimed in claim 2, further comprising a rotation sensor arranged in the hollow space of the shank, the rotation sensor sensing a rotational speed of the motor, the rotation sensor comprising a main body detachably mounted to the shank and a shaft arranged through a sensor bracket detachably mounted to the rotary frame, the shaft being fixed by a lock screw.

4. The hoisting machine as claimed in claim 3, wherein supply and discharge ports of grease are formed in the sensor bracket in positions corresponding to the bearing on a side of the sheave of the rotary part.

5. The hoisting machine as claimed in claim 1, further comprising terminal boxes arranged on the stationary frame on a side of the sheave of the rotary part, the terminal boxes providing an external electric connection.

6. An elevator system comprising:

a hoisting machine including:

a stationary part, the stationary part comprising a shank, a stationary frame integrally formed with the shank, and a stator of a motor provided to the stationary frame;

a rotary part, the rotary part comprising rotary frame rotatably supported to the shank through a bearing and facing the stationary frame, a sheave integrally formed with the rotary frame on a side opposite to the stationary frame, a rotator of the motor arranged at an outer periphery of the rotary frame and facing the motor stator, and a brake wheel integrally formed with the rotary frame and having a larger diameter than that of the sheave; and a braking device mounted to the stationary frame, the braking device coming in contact with the brake wheel for braking operation; the braking device comprising:

a pair of rotation shafts;

a pair of brake arms, the brake arms being rotatably supported to the stationary frame through the rotation shafts;

a pair of brake pads each arranged at one end of the corresponding brake arm, the brake pads contacting and separating from the brake wheel; and a brake part connected to another end of the brake arms, the brake part providing and releasing a braking force of the brake pads, wherein when centers of the rotation shafts are fulcrums, centers of contact of the brake pads with the brake wheel are points of action, and connections between the brake arms and the brake part are power points, the fulcrums, the points of action, and the power points are located in a semicircular area of the brake wheel;

a rope wound on the sheave of the rotary part of the hoisting machine; and a car connected to the rope, the car being moved upward and downward in a hoistway.

7. The elevator system as claimed in claim 6, wherein the shank of the stationary part of the hoisting machine is formed with a hollow space.

8. The elevator system as claimed in claim 7, further comprising a rotation sensor arranged in the hollow space of the shank, the rotation sensor sensing a rotational speed of the motor, the rotation sensor comprising a main body detachably mounted to the shank and a shaft arranged through a sensor bracket detachably mounted to the rotary frame, the shaft being fixed by a lock screw.

9. The elevator system as claimed in claim 8, wherein supply and discharge ports of grease are formed in the sensor bracket in positions corresponding to the bearing on a side of the sheave of the rotary part of the hoisting machine.

10. The elevator system as claimed in claim 6, further comprising terminal boxes arranged on the stationary frame on a side of the sheave of the rotary part of the hoisting machine, the terminal boxes providing an external electric connection.

* * * * *